US009939221B2

(12) United States Patent
Graves

(10) Patent No.: US 9,939,221 B2
(45) Date of Patent: Apr. 10, 2018

(54) FLEX-FIRE G2 TECHNOLOGY

(71) Applicant: Thomas Allen Graves, Buda, TX (US)

(72) Inventor: Thomas Allen Graves, Buda, TX (US)

( * ) Notice: Subject to any disclaimer, the term of this patent is extended or adjusted under 35 U.S.C. 154(b) by 0 days.

(21) Appl. No.: 15/811,212

(22) Filed: Nov. 13, 2017

(65) Prior Publication Data

US 2018/0066911 A1 Mar. 8, 2018

Related U.S. Application Data

(60) Continuation-in-part of application No. 15/421,730, filed on Feb. 1, 2017, now Pat. No. 9,816,772, which is a division of application No. 14/850,380, filed on Sep. 10, 2015, now Pat. No. 9,568,264.

(60) Provisional application No. 62/049,323, filed on Sep. 11, 2014.

(51) Int. Cl.

| | |
|---|---|
| ***F41A 19/16*** | (2006.01) |
| ***F41A 17/46*** | (2006.01) |
| ***F41A 3/68*** | (2006.01) |

(52) U.S. Cl.

CPC ..... *F41A 17/46* (2013.01); *F41A 3/68* (2013.01); *F41A 19/16* (2013.01)

(58) Field of Classification Search

CPC ..... F41A 19/10; F41A 19/16; F41A 19/17; F41A 19/24

USPC ..... 42/69.01, 69.02

See application file for complete search history.

(56) References Cited

U.S. PATENT DOCUMENTS

| | | | | |
|---|---|---|---|---|
| 571,260 | A | 11/1896 | Borchardt | |
| 580,925 | A | 4/1897 | Browning | |
| 2,618,878 | A * | 11/1952 | Mulno | F41A 3/68 42/16 |
| 3,631,620 | A * | 1/1972 | Ohira | F41A 3/22 42/16 |
| 3,657,959 | A | 4/1972 | Kart | |
| 4,127,056 | A | 11/1978 | Kart | |
| 4,253,377 | A | 3/1981 | Arnett | |
| 4,455,777 | A | 6/1984 | Callies | |
| 4,459,774 | A | 7/1984 | Ferretti | |
| 4,539,889 | A | 9/1985 | Glock | |
| 4,735,009 | A | 4/1988 | Jett, Jr. | |
| 4,955,157 | A | 9/1990 | Brighton et al. | |
| 5,036,612 | A | 8/1991 | Jennings | |
| 7,398,723 | B1 | 7/2008 | Blakley | |
| 8,448,366 | B2 | 5/2013 | Faifer | |
| 8,701,326 | B2 | 4/2014 | Zonshine | |
| 9,021,732 | B2 | 5/2015 | Johnson | |
| 2011/0289813 | A1 | 12/2011 | Serandour | |
| 2014/0366418 | A1 | 12/2014 | Stakes | |
| 2015/0184967 | A1 | 7/2015 | Whittington | |
| 2017/0089654 | A1 * | 3/2017 | Findlay | F41A 3/66 |

FOREIGN PATENT DOCUMENTS

| | | |
|---|---|---|
| GB | 18774 | 11/1893 |

OTHER PUBLICATIONS http://tacconusa.com/ Tac Con 3MR Trigger System.

* cited by examiner

*Primary Examiner* — Reginald Tillman, Jr.

(74) *Attorney, Agent, or Firm* — Timothy D. Bennett; Emerson Thomson Bennett

(57) ABSTRACT

A trigger activated arm may use engagement of an integrated gun bolt cam with an integrated trigger cam to reposition the trigger as the gun bolt reciprocates. The gun bolt trigger engagement may be used to reset the trigger.

20 Claims, 5 Drawing Sheets

FLEX-FIRE G2 TECHNOLOGY

This application is a Continuation-in-Part of U.S. Pat. No. 9,816,772 entitled FLEX-FIRE TECHNOLOGY, which is a divisional of U.S. Pat. No. 9,568,264 entitled FLEX-FIRE TECHNOLOGY, which claims priority to provisional patent application U.S. Ser. No. 62/049,323, entitled FLEX-FIRE TECHNOLOGY, all of which are incorporated herein by reference.

I. BACKGROUND

A. Field of the Invention

My present subject is high energy trigger reset methods and apparatus that include hammer fired, gun bolt driven automatic trigger reset technology that is herein referred to as FLEX-FIRE G2 TECHNOLOGY. The following is a specification of my invention, including attached drawings. This specification is intended to be understood by a person skilled in the mechanical arts inclusive of modern semi-automatic arms.

B. Description of Related Art

In the art of trigger activated small arms it may be increasingly desirable to be capable of more rapidly repeatable, and more accurate shot placement, or in any way to decrease repeatable operating cycle duration within mechanical practicality.

The concept of a semi-automatic arm includes a manually activated trigger that fires once per operating cycle. In the case of a small arm with a reciprocating gun bolt an operating cycle is comprised of two strokes of the gun bolt. One stroke is rearward, one stroke is forward. Each operating cycle requires an independent depression of the trigger to initiate, and also requires a reset of the trigger per operating cycle to initiate a subsequent operating cycle.

In my technical writing that is dated Sep. 11, 2014, with revisions thereof ultimately entitled FLEX-FIRE TECHNOLOGY of U.S. Pat. No. 9,568,264, I've introduced a gun bolt driven direct mechanical reset of a trigger. This technology accomplishes digital precision of trigger reset function at any given gun bolt reciprocation rate, and therefore has provided a fundamental basis for futuristic high-speed semi-automatic fire control/operating systems.

Flex-Fire technology proper, in this context, is a technical term referring to high energy trigger reset technology. Basically, this implies that a trigger depression followed by a high energy automatic trigger reset, are accomplished per unit firing cycle. The use of "high" energy in the descriptor is given to indicate a trigger reset force that exceeds the typical force of manual activation, and therefore could be considered a positive displacement trigger reset.

Trigger activated semi-automatic arms that utilize technological claims of U.S. Pat. No. 9,568,264 include a high energy trigger reset method and apparatus having a striker type ignition system.

II. SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

According to some embodiments of this invention, a trigger activated arm may include a frame; a barrel that is supported to the frame; a trigger that has an integrated cam surface and is depressible to fire the arm; and, a gun bolt that has an integrated cam surface and reciprocates with respect to the frame. As the gun bolt reciprocates, the gun bolt integrated cam surface may engage the trigger integrated cam surface to reposition the trigger.

According to other embodiments of this invention, a method may include the steps of: (A) providing a trigger activated arm having a frame; a barrel that is supported to the frame; a trigger that has an integrated cam surface and is depressible to fire the arm; and, a gun bolt that has an integrated cam surface and reciprocates with respect to the frame; and, (B) providing the trigger activated arm to be operable to reposition the trigger as the gun bolt reciprocates and the gun bolt integrated cam surface engages the trigger integrated cam surface.

According to other embodiments of this invention, a trigger reset mechanism may use an integrated cam surface on a gun bolt that engages an integrated cam surface on a trigger to reset the trigger into a pre-depressed position as the gun bolt reciprocates.

According to still other embodiments of this invention, mechanical contact between a trigger and a gun bolt may prevent depression of a trigger during any part of the operating cycle except when in battery or within 15% of forward gun bolt stroke.

According to yet other embodiments of this invention, mechanical contact between a trigger and a gun bolt may prevent depression of a trigger during any part of the operating cycle except when in battery or within 10% of forward gun bolt stroke.

According to still other embodiments of this invention, mechanical contact between a trigger and a gun bolt may prevent depression of a trigger during any part of the operating cycle except when in battery or within 5% of forward gun bolt stroke.

Numerous benefits and advantages of this invention will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
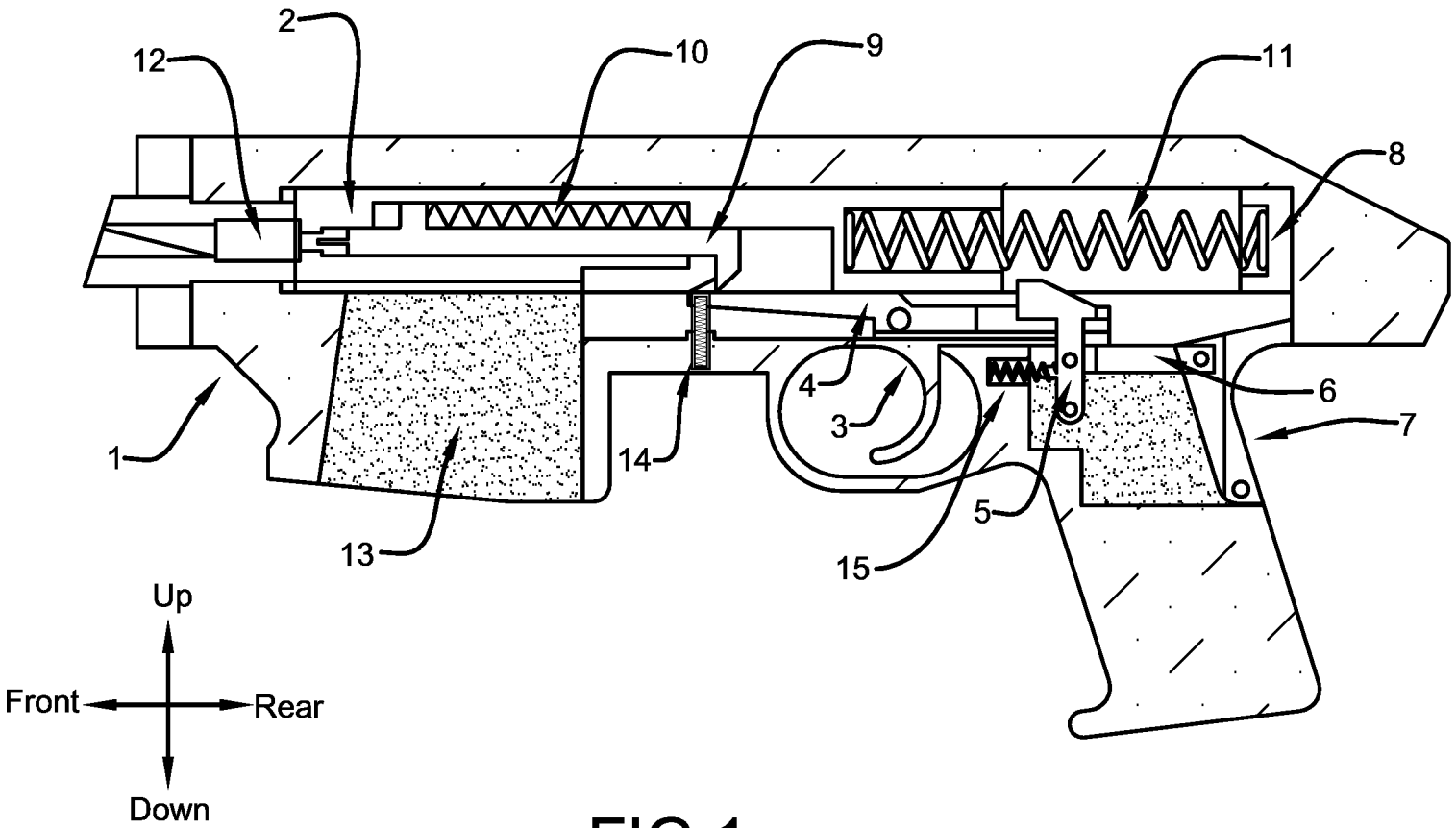
FIG. 1 is a side view, in partial cutaway, showing an arm equipped with embodiments of the Flex-Fire Technology of this invention.

Referring now to the drawings wherein the showings are for purposes of illustrating embodiments of the invention only and not for purposes of limiting the same, and wherein like reference numerals are understood to refer to like components, following is a list of components according to some embodiments of this invention:

1: A frame (stationary part)
2: A gun bolt (reciprocating type)
3: A trigger
4: A disconnector (integrated safety sear type)
5: A safety lock
6: A safety transfer bar
7: A safety paddle (engagement device)
8: A buffer (elastic bushing type)
9: A striker (integrated sear type)
10: A striker biasing member which may be a spring (helical compression type)
11: A main recoil biasing member which may be a spring (helical compression type)
12: A chamber face (barrel and chamber assembly)
13: A magazine (standard box magazine—details omitted for clarity)
14: A disconnector biasing member which may be a spring (helical compression type)
15: A safety biasing member which may be a spring (helical compression type)
16: Sear surface of trigger 3
17: Pivot
18: Sear surface of striker 9
19: Bottom surface of gun bolt 2
20: Sear surface of disconnector 4
21: Space between gun bolt 2 and trigger 3
22: Top surface of trigger 3

Figure 2:
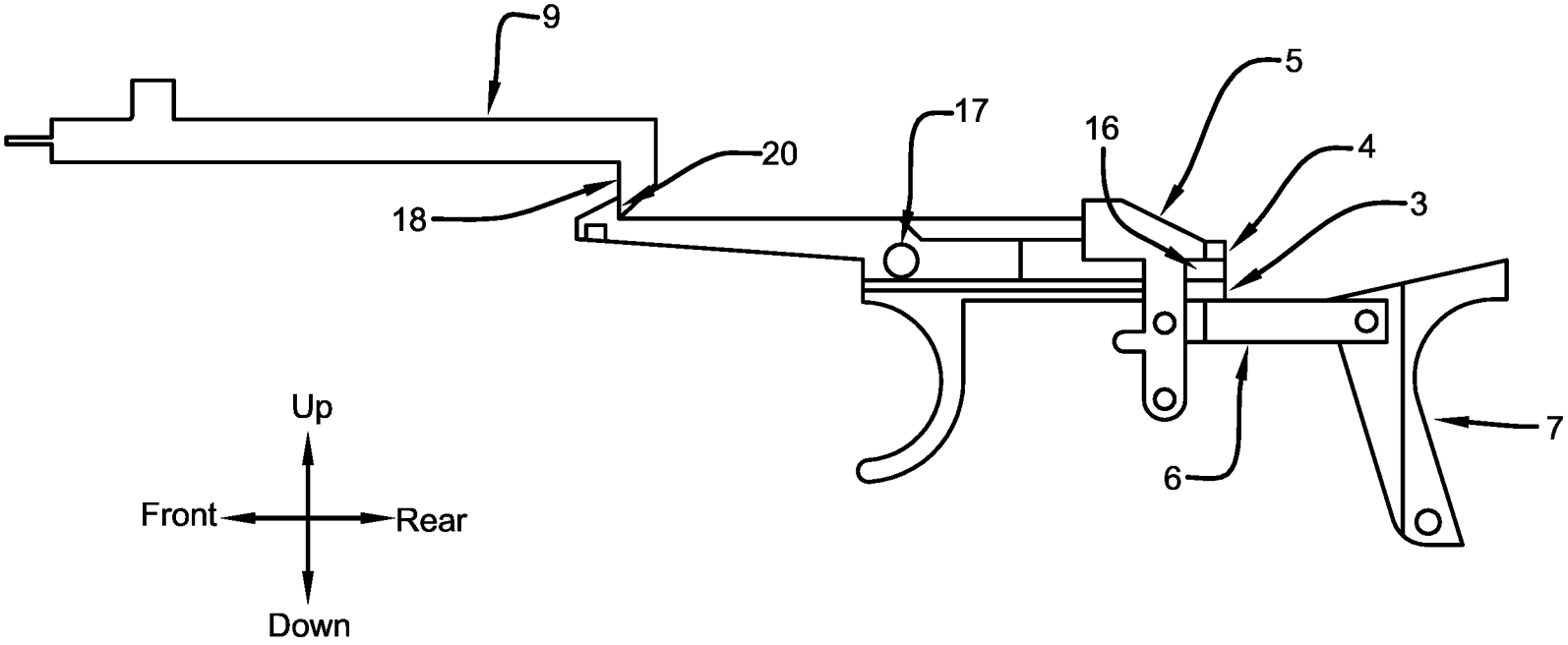
FIG. 2 shows portions of the arm of FIG. 1 separated for clarity.
Figure 3:
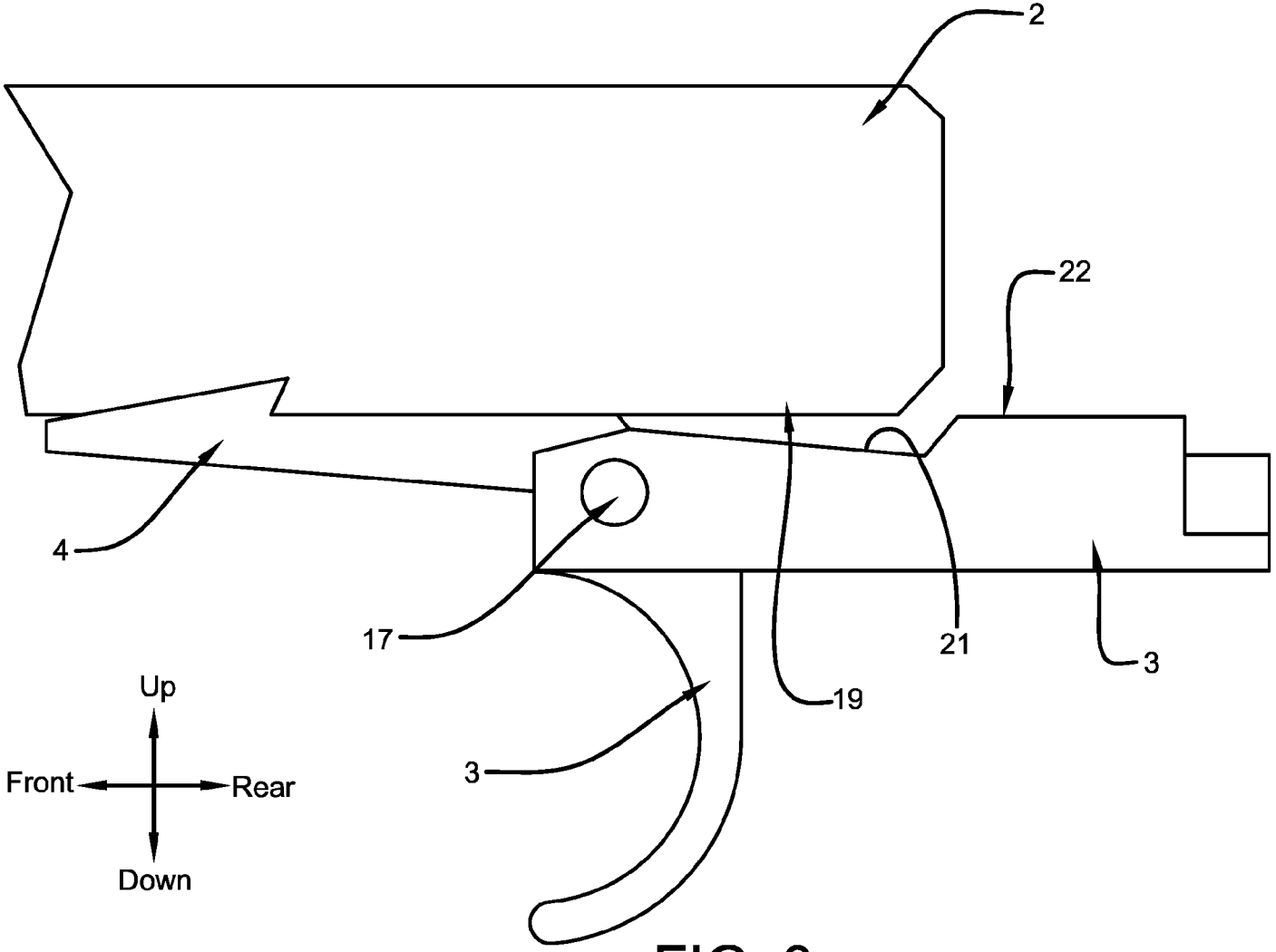
FIG. 3 shows portions of an arm with components similar to those shown in FIG. 1 but with numerous components removed for clarity. The gun bolt is shown in the full frontward position and the trigger is shown in the non-depressed position.

With reference now to FIGS. 1, 2 and 3, Flex-Fire Technology (FFT), is designed to fire common cartridge type ammunition (not shown) from within chamber 12. The system is operated by hand and trigger 3 is finger activated by depressing trigger 3 in the rearward direction. In order to initiate an operational cycle from the loaded chamber 12, safety paddle 7 may be depressed towards the chamber 12 by user energy. This depression moves safety transfer bar 6 against biasing member 15 and simultaneously pivots safety lock 5 towards the chamber 12 (clockwise). When the safety lock 5 is depressed to a given extent, it swings clear of sear surface 16 on the trigger 3. Once the trigger 3 and disconnector 4 are free to swing upwards (counterclockwise) around pivot 17, the FFT is ready to fire a cartridge.

Depression of the trigger 3 by a user will now result in a cartridge being fired and an operational cycle to be completed to the extent of reloading chamber 12 from magazine 13 in preparation for a subsequent depression of the trigger 3. Reloading details have been omitted for clarity.

Upon depression of the trigger 3, the trigger 3 and the disconnector 4 will pivot upwards (counterclockwise) about pivot 17 farthest from the chamber 12. Note in FIG. 3 the space 21 between the top of the trigger 3 and the bottom of the gun bolt 2 that provides room for this pivoting motion when the gun bolt 2 is positioned forward. The disconnector 4 acts against a disconnector biasing member 14 and is pulled downward at any point forward of the trigger pivot 17. As the disconnector 4 breaks contact with sear surface 18 on striker 9, striker 9 will react against striker biasing member 10 and fire a cartridge via stored kinetic energy.

Ultimately, as a cartridge is fired and a bullet is propelled away from the gun bolt 2, subsequent recoil energy pushes the cartridge case away from the chamber 12—pushing the gun bolt 2 rearwardly in the process. During this movement the cartridge case will travel at least its own original length while in direct contact with the gun bolt 2 and then it will be ejected in the usual manner, which has been omitted for clarity. The ejection function, including the compression of main recoil biasing member 11, is performed in parallel with overall fire control group reset.

During the earliest rearward movement of the gun bolt 2, the trigger 3 is forced to reset by interference contact with the gun bolt 2. Specifically, in one embodiment shown in FIG. 3, bottom surface 19 of the gun bolt 2 contacts upper surface 22 of the trigger 3 as the gun bolt 2 moves rearward. The gun bolt 2 may then hold down the trigger 3 throughout the remaining rearward movement. During this movement the disconnector 4 is elastically displaced (compressing disconnector biasing member 14) as striker 9 passes over it. When the gun bolt 2 has reached its most rearward position, the trigger 3 is already reset and held in place by the gun bolt 2.

As the gun bolt 2 begins to move frontward towards the chamber 12 under force from recoil biasing member 11, disconnector 4 sear surface 20 will catch the sear surface 18 of the striker 9 and begin to react against a striker biasing member 10. A new cartridge is simultaneously stripped from a magazine 13 and begins to be pushed by the gun bolt 2 towards the chamber 12. When the gun bolt 2 arrives at its most forward position, a new cartridge will have been loaded in the chamber 12 and the trigger 3 will be clear of interference with the gun bolt 2. This completes a single operating cycle of two strokes. One complete operating cycle is considered 100% of the operating cycle. Subsequent operating cycles can be initiated by subsequent depressions of the trigger 3. Note that in some embodiments, such as shown in FIG. 3, the trigger 3 is blocked from depression by the rigid mechanical contact between the trigger 3 and the gun bolt 2 up to 99% of the operating cycle. The precise percent of the operating cycle can be adjusted to other percentages by a person of skill in the art.

Elaborations Concerning Flex-Fire Technology

The striker 9 is energized as the gun bolt 2 returns to a most forward position effectively reducing secondary rebound from the chamber face 12.

The trigger 3 may be positively mechanically reset approximately as early as the first 10% of the operating cycle. This may give the user the longest possible time to sense and/or react to the reset event without increasing the overall time between operating cycles.

Clearances between the interference of the trigger 3 and the gun bolt 2 may be adjusted to allow the trigger 3 to be depressed slightly before the most forward movement of the gun bolt 2. In rapid fire operation, this allows for lower "running" trigger pull weight and concurrently shorter striker strokes. Earlier trigger 3 depression results in a shorter striker 9 stroke. The striker biasing member 10 compression is proportionate to the length of striker 9 stroke.

The safety system may automatically lock the trigger 3 and the disconnector 4 simultaneously with a single safety lock 5 upon the rearward release of the safety paddle 7 that reacts against safety biasing member 15. The trigger 3 is locked from depression via hook function of the safety lock 5 applied against the sear surface 16.

Ramifications Concerning Flex-Fire Technology

Self-preservation is the ultimate common determinant of human demands and world history has most certainly indicated that the biggest threat to human beings is found within the same species. The need for more and more advantageous means to defend interest and project interest should be well understood by many people of all cultures familiar to international trade and influence. History also indicates that many, if not the majority of those human versus human threats are acted out at close range with various types of combat tools.

Pistols, carbines, and rifles are primary tools of survival within the scope of modern civilization. These tools are among the most desirable close range fighting tools and are totally indispensable within the context of a civilization of free persons. All free people demand an ability to control and apply the most effective means of self-defense possible.

Flex-Fire Technology is devised to provide a free people a practical means to more effectively defend or project interest at close ranges against other highly developed combat tools that may be applied against them.

This technology provides the potential of increasing both the rate of fire and the precision of fire at higher rates beyond the fundamental design capabilities of pre-existing semi-automatic arms.

Figure 4:
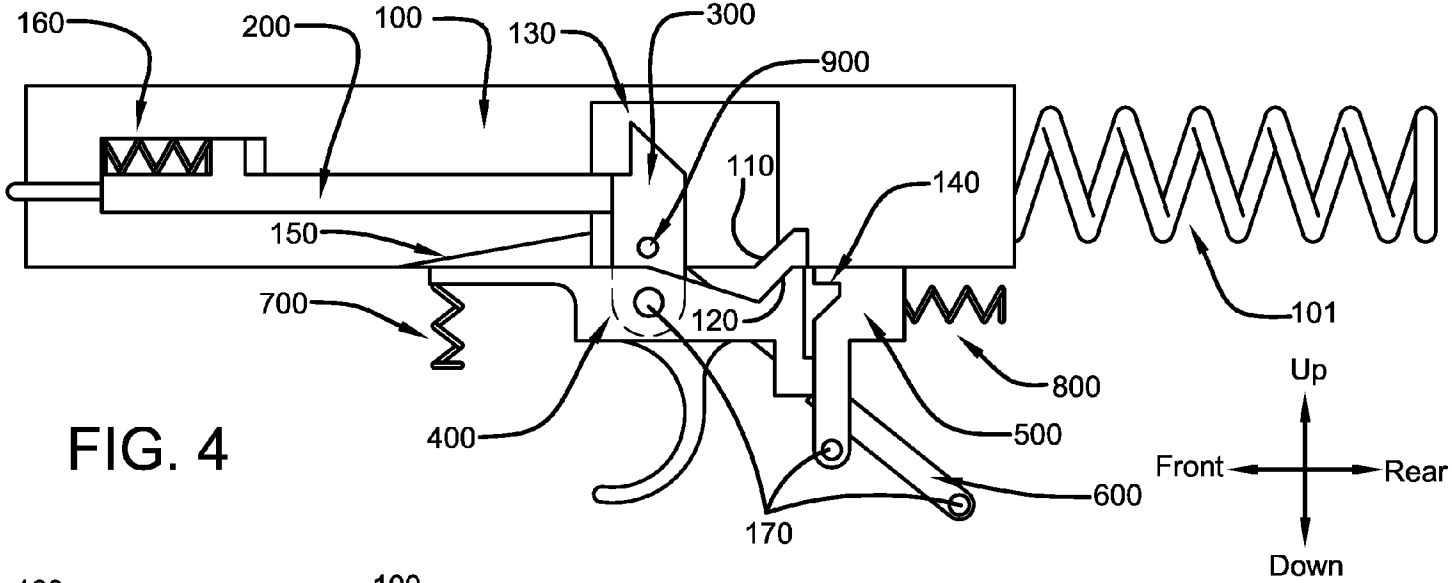
FIG. 4 is a side view, in partial cutaway, showing portions of an arm equipped with embodiments of the Flex-Fire G2 Technology of this invention with the hammer in an uncocked position.
Figure 5:
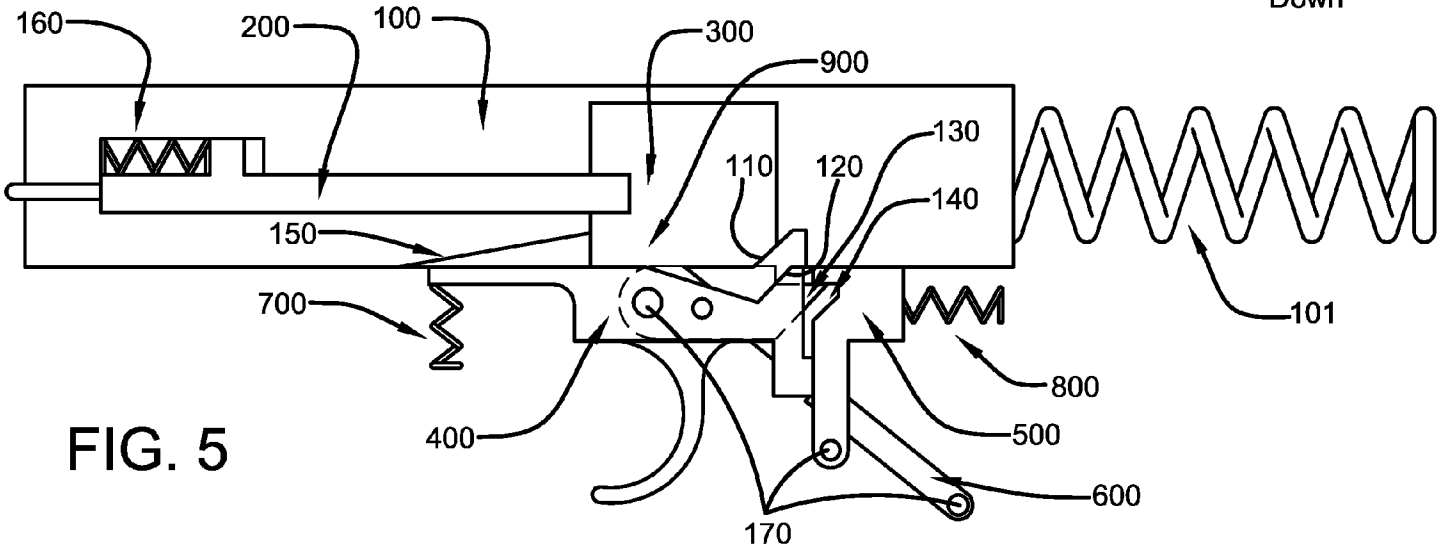
FIG. 5 is a view similar to that shown in FIG. 4 but with the hammer in a cocked position.
Figure 6:
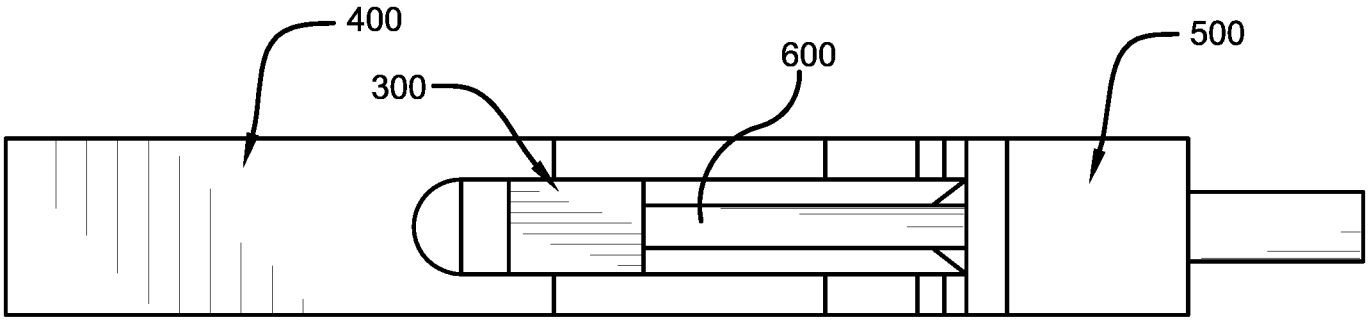
FIG. 6 is a top view of the arm shown in FIG. 4.

With reference now to FIGS. 4, 5 and 6, a method of high energy trigger reset that features a depressable trigger in battery, or in firing position, and that also includes a gun bolt driven mechanical reset of a hammer type ignition system may be realized within my Flex-Fire G2 Technology.

My invention becomes embodied within a basic mechanical arrangement of both stationary and moving parts similar to those within known practice. Following is a list of components according to some embodiments of this invention:

100: gun bolt
200: firing pin
300: hammer
400: trigger
500: disconnector
600: cylinder type spring assembly
700: spring
800: spring
900: hammer/hammer spring pivot
101: spring
110: gun bolt notch/ramp; gun bolt integrated cam surface
120: trigger ramp; trigger integrated cam surface
130: hammer sear surface
140: disconnector sear surface/notch
150: hammer re-cocking ramp
160: spring
170: pivot(s)

Referring now to FIGS. 4-6, my invention is an overall methodology that consists of manually or remotely depressing a trigger 400 towards the rear that will cause an ignition within the chamber/barrel that is not shown for the sake of simplicity but may be similar to that shown in FIG. 1. According some embodiments, at any given point of an operational cycle concurrent to, or after ignition, the trigger 400 may be repositioned when the gun bolt's integrated cam surface 110 engages the trigger's integrated cam surface 120. According to other embodiments, at any given point of an operational cycle concurrent to, or after ignition, the trigger 400 may be caused to nearly so, or to fully accomplish a high energy reset to the forward/pre-depressed position, and may become depress-able again at or near the moment that a subsequent ignition event is possible within the chamber/barrel assembly that is not shown for the sake of simplicity. Specifically, the trigger reset mechanism in some embodiments may prevent depression of the trigger during any part of the operating cycle except when in battery or within 15% of the forward bolt stroke. This would give more than 0.250 inch of ignition lead to a 2 inch stroke gun bolt system, which is predictably nominal for certain applications. In other embodiments, the trigger reset mechanism may prevent depression of the trigger during any part of the operating cycle except when in battery or within 10% of the forward bolt stroke. In yet other embodiments, the trigger reset mechanism may prevent depression of the trigger during any part of the operating cycle except when in battery or within 5% of the forward bolt stroke. The specific percentage will depend on the particular application as understood by a person of skill in the art.

Another variation of my invention utilizes a hammer type ignition system that includes a high energy reset function that is realized by depressing a trigger 400 rearward against its own spring 700 pressure to cause a disconnector 500 to be pushed rearward against its own spring 800 pressure, releasing the contact between a hammer sear surface 130 and a disconnector sear surface/notch 140, resulting in a hammer 300 being held against its own spring 600 pressure, to release upward and forward rotationally (counterclockwise as shown) around a pivot 170 while retained by pivot 900, from the position shown in FIG. 5 to the position shown in FIG. 4, resulting in a forcible strike against the rear of a firing pin 200. The use of "high" energy is provided to indicate a force that exceeds the typical force of manual activation, and therefore could be considered a positive displacement trigger reset. Striking the firing pin 200 against its own spring 160 pressure drives the firing pin 200 forward, causing an ignition within the chamber/barrel that is not shown for the sake of simplicity but may be similar to that shown in FIG. 1. At this point the integrated trigger cam surface 120 is not engaged to the integrated gun bolt cam surface 110.

The hammer 300 striking the firing pin 200 will fire a primer of a cartridge within a chamber/barrel that is not shown for the sake of simplicity but may be similar to that shown in FIG. 1. Upon firing, the gun bolt 100 will be driven by recoil rearward against its own spring pressure 101. As the gun bolt 100 is moved rearward by the force of recoil, the integrated trigger cam surface 120 will engage with the integrated gun bolt cam surface 110. This engagement (or interference) will act as a cam action causing the trigger 400 to reposition. In some embodiments, this engagement will automatically reset the trigger to the pre-depressed position. Following this, the hammer 300 will then be re-cocked by the hammer re-cocking ramp 150 (a form which may be integrated into the design of the gun bolt 100) as the gun bolt 100 continues to move rearward. Upon completion of a rearward bolt stroke, the gun bolt 100 direction reverses and a forward stroke of the gun bolt 100 is driven with its own spring pressure 101. As the forward motion moves the gun bolt into battery, or firing position, the integrated trigger cam surface 120 and integrated gun bolt cam surface 110 are freed from engagement/interference, and the trigger 400 may be pulled again to initiate a subsequent operating cycle. This operating cycle may be repeated indefinitely. The trigger 400 may be reset within the first few percent of rearward gun bolt stroke, but may be locked and incapable of being pulled again until the last few percent of the forward bolt stroke within each independent operating cycle.

In this particular arrangement, with the trigger 400 being automatically reset during initial rearward reaction to the mass of a projectile moving forward, the operator perception of mechanical motion is effectively minimized. When that factor is combined with the trigger 400 being locked until the last 15% or less of forward gun bolt travel, the result may be maximized recovery or finger dwell duration, between operating cycles, that may allow for maximized controllability, comfort, and dependability.

Elaborations concerning Flex-Fire 2 Technology

It will become obvious with comprehensive consideration that my invention's basic methodology of positive displacement/high energy trigger reset per unit operating cycle combined with unlocking a trigger at or near being in battery can be accomplished in numerous variations by practical mechanisms. Mechanical contact between the trigger and the gun bolt may be used to prevent depression of the trigger until such depression is desired.

This invention provides an effective, and technologically advantageous means capable of exceeding many features, and capabilities of existing fire control/operating system methodologies whether they are low energy trigger reset, medium energy trigger reset, select-fire, binary trigger, bump-fire, slide-fire, or full-auto only type technologies. I do not limit my invention's applications to any particular ammunition cycling mechanisms, whether hammer fired apparatus, or striker fired apparatus, or otherwise.

No form of my invention may be construed as an "automatic firearm" or machine gun in any technical or lawful manner within American engineering nomenclature or constitutionally established context. The US BATFE defines a machine gun in a very strict technical sense. The US National Firearms Act defines a machine gun as "Any weapon which shoots, is designed to shoot, or can be readily restored to shoot, automatically more than one shot without manual reloading, by a single function of the trigger". This definition is taken to imply a historically well-established concept. This concept effectively limits access to a firearm that may continue to fire automatically in a dead operator's hand or with a single accidental, or incidental trigger depression. In general a trigger may be moved towards, and from the operator, completing an entire trigger operating cycle. There are two distinct trigger functions and a small arm must fire more than one shot per trigger function, or two shots per trigger operating cycle to meet the lawfully accepted definition of an "automatic firearm", or a machine gun. My invention is technically a semi-automatic type operating system that strictly and with digital precision provides a single shot per operating cycle, and this in no way qualifies my Invention as a machine gun, and therefore is not included as a NFA restricted weapon, nor does it necessarily constitute a BATFE controlled firearm of any type.

Ramifications Concerning Flex-Fire 2 Technology

Flex-Fire 2 Technology provides small arms having the potentials of increased rates of fire, precision at higher rates of fire, and user comfort, beyond the capabilities of pre-existing fire control/operating systems.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved.

I claim:

1. A trigger activated arm comprising:
a frame;
a barrel that is supported to the frame;
a trigger that: (1) has an integrated cam surface; and, (2) is depressible to fire the arm; and,
a gun bolt that: (1) has an integrated cam surface; and, (2) reciprocates with respect to the frame;
wherein as the gun bolt reciprocates, the gun bolt integrated cam surface engages the trigger integrated cam surface to reposition the trigger.

2. The trigger activated arm of claim 1 wherein the gun bolt integrated cam surface engages the trigger integrated cam surface to reset the trigger into a pre-depressed position.

3. The trigger activated arm of claim 2 wherein a high energy reset force that exceeds the typical force of manual activation is used to reset the trigger.

4. The trigger activated arm of claim 1 wherein:
the trigger is depressible to fire the arm once per operating cycle;
the gun bolt reciprocates in a rearward stroke and forward stroke; and,
mechanical contact between the trigger and the gun bolt prevents depression of the trigger during any part of the operating cycle except when in battery or within 15% of the forward gun bolt stroke.

5. The trigger activated arm of claim 1 wherein the arm is a semi-automatic arm.

6. The trigger activated arm of claim 1 comprising a hammer that activates a firing pin to fire the arm.

7. The trigger activated arm of claim 1 comprising a striker that fires the arm.

8. A method comprising the steps of:
(A) providing a trigger activated arm comprising:
a frame;
a barrel that is supported to the frame;
a trigger that: (1) has an integrated cam surface; and, (2) is depressible to fire the arm; and,
a gun bolt that: (1) has an integrated cam surface; and, (2) reciprocates with respect to the frame; and,
(B) providing the trigger activated arm to be operable to reposition the trigger as the gun bolt reciprocates and the gun bolt integrated cam surface engages the trigger integrated cam surface.

9. The method of claim 8 wherein step (B) comprises the step of:
providing the trigger activated arm to be operable to reset the trigger into a pre-depressed position as the gun bolt reciprocates and the gun bolt integrated cam surface engages the trigger integrated cam surface.

10. The method of claim 8 wherein step (B) comprises the step of:
providing the trigger activated arm to use a high energy reset force that exceeds the typical force of manual activation to reset the trigger.

11. The method of claim 8 wherein:
step (A) comprises the steps of:
providing the trigger to be depressible to fire the arm once per operating cycle; and,
providing the gun bolt to reciprocate in a rearward stroke and forward stroke; and,
step (B) comprises the step of: providing the trigger activated arm to be operable using mechanical contact between the trigger and the gun bolt to prevent depression of the trigger during any part of the operating cycle except when in battery or within 15% of the forward gun bolt stroke.

12. The method of claim 11 wherein step (B) comprises the step of:
providing the trigger activated arm to be operable using mechanical contact between the trigger and the gun bolt to prevent depression of the trigger during any part of the operating cycle except when in battery or within 5% of the forward gun bolt stroke.

13. The method of claim 8 wherein step (A) comprises the step of:

providing the trigger activated arm to be a semi-automatic arm.

14. The method of claim 8 wherein step (A) comprises the step of:

providing the trigger activated arm to comprise a hammer that activates a firing pin to fire the arm.

15. The method of claim 8 wherein step (A) comprises the step of:

providing the trigger activated arm to comprise a striker that fires the arm.

16. A trigger reset mechanism for use with a trigger activated arm having: a frame; a barrel that is supported to the frame; a trigger that is depressible to fire the arm; and, a gun bolt that reciprocates with respect to the frame; the trigger reset mechanism comprising:

an integrated cam surface on the gun bolt that engages an integrated cam surface on the trigger to reset the trigger into a pre-depressed position as the gun bolt reciprocates.

17. The trigger reset mechanism of claim 16 wherein the trigger reset mechanism uses a high energy reset force that exceeds the typical force of manual activation.

18. The trigger reset mechanism of claim 16 wherein mechanical contact between the trigger and the gun bolt prevents depression of the trigger during any part of an operating cycle except when in battery or within 15% of a forward gun bolt stroke.

19. The trigger reset mechanism of claim 16 wherein the trigger is automatically reset once per operating cycle.

20. The trigger reset mechanism of claim 16 wherein the trigger is reset during an earliest 50% of an operating cycle.

* * * * *